US006271186B1

(12) United States Patent
Hardee et al.

(10) Patent No.: US 6,271,186 B1
(45) Date of Patent: Aug. 7, 2001

(54) ELECTRICAL CONTACT LUBRICANT COMPOSITION FOR INHIBITING FRETTING FAILURE

(76) Inventors: Harry C. Hardee, 4044 Shadow Run; Neil R. Aukland, 1755 Royal Dr., both of Las Cruces, NM (US) 88011

( * ) Notice: Subject to any disclaimer, the term of this patent is extended or adjusted under 35 U.S.C. 154(b) by 0 days.

(21) Appl. No.: 09/420,373

(22) Filed: Oct. 18, 1999

(51) Int. Cl.[7] ..... C10M 105/18; C10M 111/02

(52) U.S. Cl. ..... 508/581; 508/579; 508/580; 427/96; 427/384; 427/435; 427/443

(58) Field of Search ..... 508/580, 581, 508/579

(56) References Cited

U.S. PATENT DOCUMENTS 3,567,783 * 3/1971 Brown ..... 260/613
3,860,661 * 1/1975 Hammann et al. ..... 252/52
4,857,219 * 8/1989 Cargnel ..... 252/52 R
4,971,722 * 11/1990 Philippsen ..... 508/579
5,221,709 * 6/1993 Irving et al. ..... 524/520
5,552,071 * 9/1996 Rudnick et al. ..... 508/581
5,639,719 * 6/1997 Tanaka et al. ..... 508/580
5,656,582 * 8/1997 Shiraishi et al. ..... 508/108
5,853,797 * 12/1998 Fuchs et al. ..... 427/96

* cited by examiner

*Primary Examiner*—Ellen M. McAvoy

(57) ABSTRACT

This invention describes a contact lubricant composition for protecting electrical contacts from failure by fretting damage. This lubricant composition is also able to restore and rejuvenate electrical contacts that have failed in service by fretting damage, allowing such contacts to be returned to service. This contact lubricant consists of an optimum mixture of fifty volume percent polyphenyl ether and fifty volume percent polypropylene monobutyl ether. This combination of materials in a lubricant mixture is still effective at volume percentages of polyphenyl ether as low as ten volume percent. This contact lubricant composition was developed and demonstrated to be effective by extensive laboratory fretting tests on various common electrical contact materials and configurations.

6 Claims, No Drawings

ELECTRICAL CONTACT LUBRICANT COMPOSITION FOR INHIBITING FRETTING FAILURE

BACKGROUND OF THE INVENTION

The present invention relates to an electrical contact lubricant composition designed to prevent or overcome a specific type of electrical contact failure.

Electrical contacts can fail by a number of different mechanisms but a common failure mechanism results from fretting, which is relative micro-motion vibration of the contact surfaces. The source of fretting motion comes from background mechanical, thermal or electrical disturbances. These vibration sources are almost always present in equipment that use electrical contacts. Fretting failure of an electrical contact surface can occur when the amplitude of the fretting motion is on the order of the size of the contacting surface asperities, which form the microscopic electrical contact paths at the contact surface. The asperity sizes and critical fretting amplitudes are typically on the order of 10 to 100 microns in magnitude. Fretting failure occurs when debris, either from the action of wear or from outside contamination, becomes lodged between contacting surface asperities and separates the asperities sufficiently to interrupt the flow of electric current. A contact lubricant that is effective against fretting failure must specifically treat the debris problem by keeping debris from accumulating and intruding into critical asperity contact points.

Many electrical contact lubricants have been proposed over the years, but such products are not specifically designed and tailored to inhibit or eliminate fretting failure of electrical contacts. Few, if any, of such contact lubricants have been demonstrated by extensive laboratory testing to significantly reduce fretting failure. The function of a typical lubricant, according to Webster's dictionary, is primarily to reduce friction and, to a lesser extent, to reduce heat and wear. A reduction in friction in the presence of background vibration will tend to increase the amplitude of fretting motion. An increase in fretting amplitude, with other factors held constant, has been shown experimentally to increase fretting failure. A contact lubricant designed to prevent or reduce fretting failure must focus on the elimination of debris build-up at the asperity contact points rather than on the reduction of friction. The use of almost any contact lubricant will reduce wear, and in turn, should reduce the amount of local debris produced by wear. However, debris that ultimately causes fretting failure can often result from outside sources of contamination rather than be the product of local wear. A contact lubricant that specifically addresses the reduction of elimination of fretting failure must focus primarily on the debris problem.

SUMMARY

It has been discovered that an electrical contact lubricant composition, consisting of a mixture of polyphenyl ether and polypropylene monobutyl ether, is able to dramatically improve the fretting failure resistance of new electrical contacts and is able to rejuvenate electrical contacts that have previously failed in service. This unique lubricant composition combines the strong clustering and surface adherence properties of polyphenyl ether with the continuous coating and debris removal properties of polyproplylene monobutyl ether to produce a synergistic effect in lubricant fretting resistance. In addition, this contact lubricant composition is able to recover or rejuvenate electrical contacts that have already experienced fretting failure, allowing these contacts to be returned to service. Although the combination of the two basic ingredients in this electrical contact lubricant might have been expected to offer some possible improvement in fretting resistance of electrical contacts, the large degree of improvement observed apparently results from a synergistic effect that was not anticipated and only became apparent after extensive laboratory fretting tests on many different materials. Further, the ability of this electrical contact lubricant to rejuvenate previously failed electrical contacts was totally unexpected and was discovered only by means of laboratory tests.

The composition of the electrical contact lubricant in this present invention consists of an optimum mixture of fifty volume percent polypropylene monobutyl ether combined with fifty volume percent polyphenyl ether. A composition mixture with as little as ten volume percent polyphenyl ether and the remainder being polypropylene monobutyl ether still exhibits significant fretting protection. The polypropylene monobutyl ether component is commercially available as UCON LB-1800-XY26 from Union Carbide Chemical Company, and the polyphenyl ether component is commercially available as OS-124 or OS-138 from SantoVac Fluids. Preparation of the contact lubricant from these two chemical components is performed by a simple mixing and stirring operation. Application of the lubricant to electrical contact surfaces is by conventional means such as brushing, dipping or by aerosol spray.

DETAILED DESCRIPTION OF THE PREFERRED EMBODIMENT

Many electrical contact lubricants described in the scientific literature are single-component, primary chemicals although often blended with an evaporable solvent for ease of application and occasionally blended with an antioxidant for corrosion protection purposes. Occasionally, some contact lubricant formulations have been based on a combination of two or more primary chemical ingredients. While it is possible to anticipate promising combinations of primary chemical ingredients, based on their individual properties and performance, the fretting protection that actually results from such combination of ingredients is only revealed after careful and extensive laboratory fretting tests on actual electrical contact surface materials.

Because fretting failure is such a serious failure mechanism for electrical contacts, a contact lubricant that inhibits or prevents fretting failure is very desirable. Such a contact lubricant must effectively resist the infusion of debris into critical asperity contact points and must effectively transport debris away from these points. This lubricant should therefore have strong surface attachment ability while resisting the infusion of foreign debris particles and yet possess the fluid properties to effectively dissolve or encapsulate debris particles and, with the aid of the fretting motion, transport these debris particles away from the critical asperity contact points. This requires fluid properties in a lubricant that are diametrically opposed. One possibility is to achieve these desired fluid properties by combining two or more different fluid components. To be effective, such a combination must maintain the unique fluid properties of the individual components in the final mixture.

The polyphenyl ethers, OS-124 and OS-138, originally produced by Monsanto Chemical Company and now produced under exclusive license by SantoVac Fluids, have been investigated in the scientific literature and have been used for many years as a contact lubricant. The primary advantage of the polyphenyl ethers, as a contact lubricant, seems to be their ability to form small islands or clumps of fluid protected zones on the contact surface. These fluid islands strongly adhere to the critical contact asperity points that conduct the electric current across the mating contact surfaces. The tendancy of polyphenyl ethers to form small islands of fluid protected regions on the contact surface rather than a continuous film over the whole contact surface is both an advantage and a shortcoming. The tenacity of adherence in small fluid islands provides excellent protection at critical asperity contact points. The unprotected surface regions in between are prime areas for corrosion and debris accumulation. The polyphenyl ethers are effective at resisting infusion of debris into the critical contact asperity regions where the electric current flows. If too much debris builds up near the contact asperity points, however, the fretting motion can mechanically drive debris into the contacting asperity points forcing the contact asperity points apart, thereby reducing or stopping the flow of electric current across the contact.

Use of polypropylene monobutyl ether as a contact lubricant is new although other members in the polyalkylene glycol chemical family have been investigated previously as potential contact lubricants. The polyalkylene glycol family of contact lubricants tend to form a continuous film over the contact surface and are excellent at removing debris from the asperity contact regions but lack the strong agglomerating adhesive power of the polyphenyl ethers. Although the general class of polyalkylene glycols has been around for a number of years, the polypropylene monobutyl ether, known by the trade name UCON LB-1800-XY26, is a recent development that we have identified to possess superior properties as a fretting-resistant electrical contact lubricant.

Based on the individual properties of polyphenyl ether and polypropylene monobutyl ether, we speculated that a mixture of the two might produce an improved contact lubricant that would resist fretting failure, provided a mixture could be developed that retained the desirable and unique fluid properties of the individual components. Ideally in this mixture, polypropylene monobutyl ether would provide a continuous protective film between the dispersed fluid islands of polyphenyl ether. This is the basis for the contact lubricant composition presented in this present invention.

The mixture composition of polyphenyl ether and polypropylene monobutyl ether that was found in laboratory tests to be most effective in resisting fretting damage was a mixture of fifty percent polyphenyl ether, either OS-124 or OS-138 variety, along with fifty percent of polypropylene monobutyl ether , UCON LB-1800-XY26 variety. This mixture composition was found to be remarkably effective in preventing the onset of fretting failure in new electrical contacts. A significant benefit in inhibiting the onset of fretting failure was found to remain when the percentage of polyphenyl ether in the mixture was reduced to a value as low as ten volume percent. Although the percentage of the more expensive polyphenyl ether component in the mixture could be reduced to lower the cost of the mixture, the optimum effect in inhibiting fretting failure occurred with a mixture that consisted of a fifty/fifty volume percent ratio of polyphenyl ether and polypropylene monobutyl ether.

Although polyphenyl ether does not dissolve or mix readily with many other chemicals, it does mix with polypropylene monobutyl ether. The mixture is prepared simply by pouring the two measured fractions together and stirring.

The contact lubricant composition mixture of polyphenyl ether and polypropylene monobutyl ether may be applied to contact surfaces by several conventional methods such as dipping, brushing, and aerosol spray. Sometimes it is desirable to add 1-Methyoxy 2-Propanol as an evaporable solvent to the lubricant composition mixture to assist in the application of the contact lubricant to the contact surface. This is particularly true in the case of application by aerosol spray. Application of the contact lubricant by brushing or aerosol spray is satisfactory for small numbers of piece parts. For rapid application of the lubricant to large numbers of contacts on production lines, the best application procedure is probably a continuous dipping application followed up with the excess lubricant blown off by a controlled air stream. This allows the excess lubricant, which is moderately expensive, to be recycled.

What is claimed is:

1. A contact lubricant for inhibiting fretting failure in electrical contacts which consists of an optimum mixture composition of fifty volume percent polypropylene glycol monobutyl ester combined with fifty volume percent polyphenyl ether.

2. A contact lubricant for inhibiting fretting failure in electrical contacts which consists of a useful mixture composition of at least ten volume percent polyphenyl ether with the remainder consisting of polypropylene glycol monobutyl ether.

3. A contact lubricant composition of claim 1 mixed with an evaporable solvent consisting of 1-Methyoxy 2-Propanol, for improving ease of application of the lubricant to the treated contact surfaces.

4. A contact lubricant composition of claim 2 mixed with an evaporable solvent consisting of 1-Methyoxy 2-Propanol, for improving ease of application of the lubricant to the treated contact surfaces.

5. A contact lubricant composition of claim 1 for inhibiting sliding wear failure in electrical contacts.

6. A contact lubricant composition of claim 2 for inhibiting sliding wear failure in electrical contacts.

* * * * *